US009521910B2

(12) United States Patent
Thornton

(10) Patent No.: US 9,521,910 B2
(45) Date of Patent: Dec. 20, 2016

(54) ADJUSTABLE BED FRAME

(76) Inventor: Bruce Thornton, Glen Allen, VA (US)

( * ) Notice: Subject to any disclaimer, the term of this patent is extended or adjusted under 35 U.S.C. 154(b) by 0 days.

(21) Appl. No.: 13/369,948

(22) Filed: Feb. 9, 2012

(65) Prior Publication Data

US 2013/0205497 A1 Aug. 15, 2013

(51) Int. Cl.
*A47C 19/04* (2006.01)

(52) U.S. Cl.
CPC ..... *A47C 19/04* (2013.01); *Y10T 29/49826* (2015.01)

(58) Field of Classification Search
CPC ..... A47C 19/04
USPC ..... 5/184, 174, 181, 112, 114, 110, 200.1
See application file for complete search history.

(56) References Cited

U.S. PATENT DOCUMENTS

| | | | | |
|---|---|---|---|---|
| 1,306,614 | A | 6/1919 | Novick | |
| 1,383,907 | A | 7/1921 | Corer | |
| 2,523,988 | A | 9/1950 | Fox | |
| 2,550,224 | A | 4/1951 | Clerc | |
| 2,567,619 | A | 9/1951 | Rosenfeld | |
| 2,607,051 | A | 8/1952 | Jackson | |
| 2,666,931 | A | 1/1954 | Clerc | |
| 2,674,749 | A | 4/1954 | Longnecker | |
| 2,960,701 | A | 11/1960 | Nawara | |
| 3,123,837 | A | 3/1964 | Paine et al. | |
| 3,713,181 | A | 1/1973 | Hougland | |
| 3,744,068 | A | 7/1973 | Harris | |
| 3,768,106 | A | 10/1973 | Fitzgerald et al. | |
| 3,824,638 | A | 7/1974 | Bogar, Jr. | |
| 3,900,906 | A | 8/1975 | Berthelsen | |
| 3,961,383 | A | 6/1976 | Spitz | |
| 3,961,384 | A | 6/1976 | Spitz | |
| RE29,029 | E | 11/1976 | Harris | |
| 3,999,231 | A * | 12/1976 | Robins | A47C 19/005 5/176.1 |
| 4,135,266 | A | 1/1979 | Knoke | |
| RE30,151 | E | 11/1979 | Nowell | |
| 4,192,028 | A | 3/1980 | Knoke | |
| 4,224,704 | A | 9/1980 | Nowell | |
| 4,679,261 | A | 7/1987 | Stanley et al. | |
| 5,099,529 | A | 3/1992 | Anderson | |
| 5,996,145 | A | 12/1999 | Taylor | |
| 6,125,484 | A | 10/2000 | Thomson | |
| 6,338,172 | B1 | 1/2002 | Taylor et al. | |
| 6,477,726 | B2 | 11/2002 | Hernandez | |
| 6,711,761 | B2 * | 3/2004 | Choi | A47C 4/286 5/112 |
| 6,951,037 | B2 | 10/2005 | Weinman et al. | |
| 7,757,314 | B2 * | 7/2010 | Yul | A47C 19/126 5/110 |
| 2009/0013464 | A1 * | 1/2009 | Tarquinio | 5/200.1 |

* cited by examiner

*Primary Examiner* — David E Sosnowski
(74) *Attorney, Agent, or Firm* — Maier & Maier, PLLC

(57) ABSTRACT

An adjustable bed frame, comprising one or more support rails with one or more fastening points, one or more slide rails, and one or more support risers. The slide rails can slidably engage with the support rails and adjustably fasten at the one or more fastening points. The slide rails and support rails can be adjustably assembled into top and bottom frame segments. The top frame segment can be connected to the bottom frame segment and supported by the support risers. The top and bottom frame segments are adjustable to accommodate more than one mattress size.

5 Claims, 8 Drawing Sheets

ADJUSTABLE BED FRAME

BACKGROUND

Mattresses for beds are manufactured and sold in a variety of different standard and non-standard sizes. Some existing bed frames are not adjustable, and are therefore only suitable for one particular size or configuration of mattress. This is inconvenient, as it requires any store with more than one mattress size in stock, or even any family with more than one mattress size in its household, to spend an unnecessary and inconvenient amount of time coordinating mattress size with frame size.

While there are adjustable bed frames available, many contain drawbacks and tradeoffs in exchange for their adjustability. In some cases, frame strength is compromised by the addition of adjustable components. In other cases, the frame adjustment process is difficult and frustrating.

SUMMARY

In one exemplary embodiment, an adjustable bed frame can be described. The frame can include support rails with fastening points, slide rails, and support risers. The slide rails can slidably engage with the support rails and adjustably fasten at the one or more fastening points. The slide rails and support rails can be adjustably assembled into top and bottom frame segments. The top frame segment can be connected to the bottom frame segment and supported by the support risers. The top and bottom frame segments can be adjustable to accommodate more than one mattress size.

In another exemplary embodiment, a method for adjusting a bed frame can be described. The method can include defining an adjustable bed frame with support rails containing fastening points, slide rails, and support risers; slidably engaging and adjustably fastening the slide rails with support rails at the fastening points; adjustably assembling the support rails and slide rails into top and bottom frame segments; connecting and supporting the top frame segment to the bottom frame segment by the support risers; and adjusting the top and bottom frame segments to accommodate more than one mattress size.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation. "Data" should be understood to be any information in either organized or unorganized form and in any format.

Generally referring to exemplary FIGS. 1-8, exemplary embodiments of an adjustable bed frame can be described. The size of the adjustable bed frame can be adjusted both vertically and horizontally in such a manner that a single adjustable bed frame can accommodate any desired mattress size.

Figure 1:
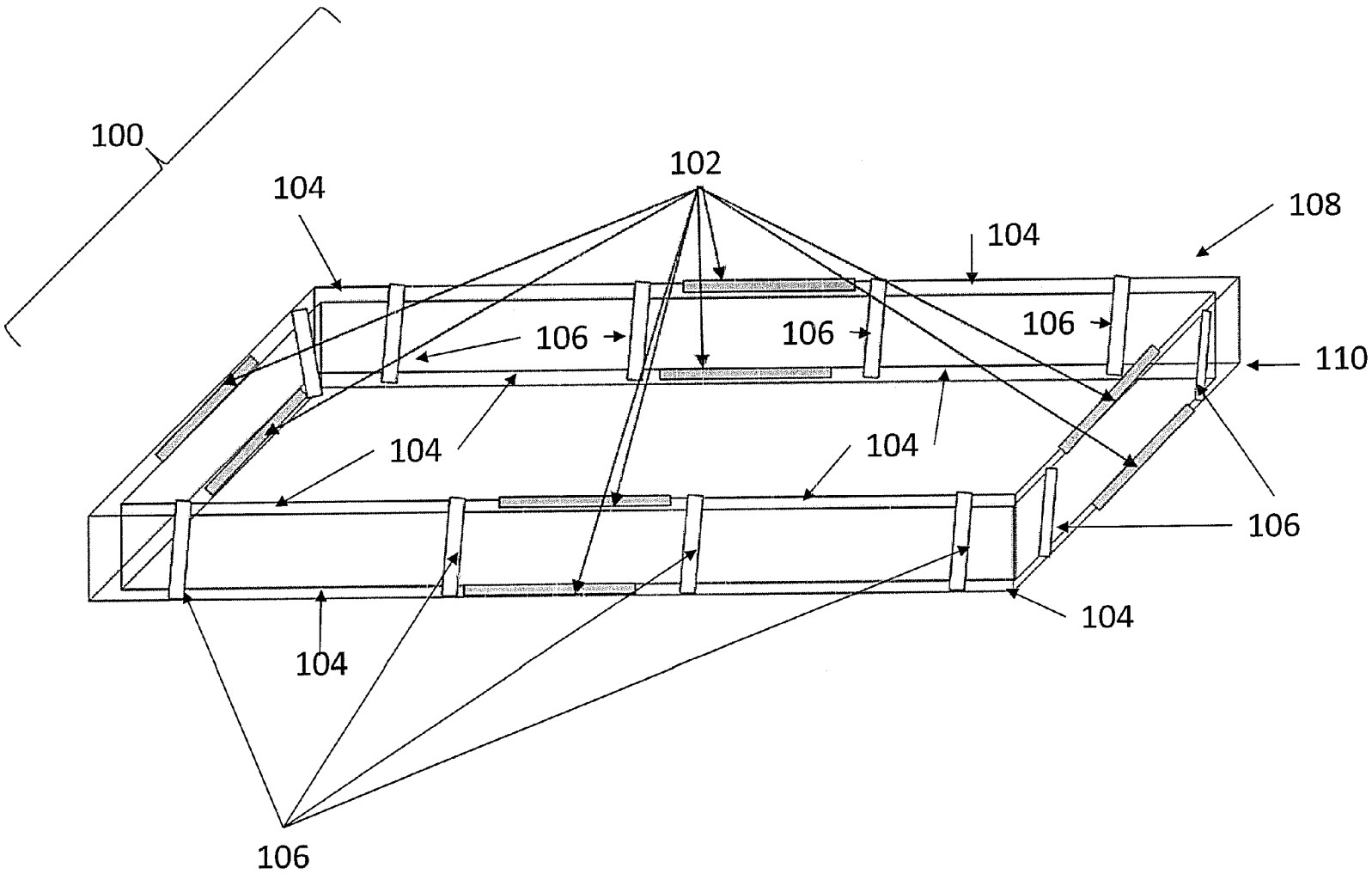
FIG. 1 is a side view of an exemplary embodiment of an adjustable bed frame.
Figure 2:
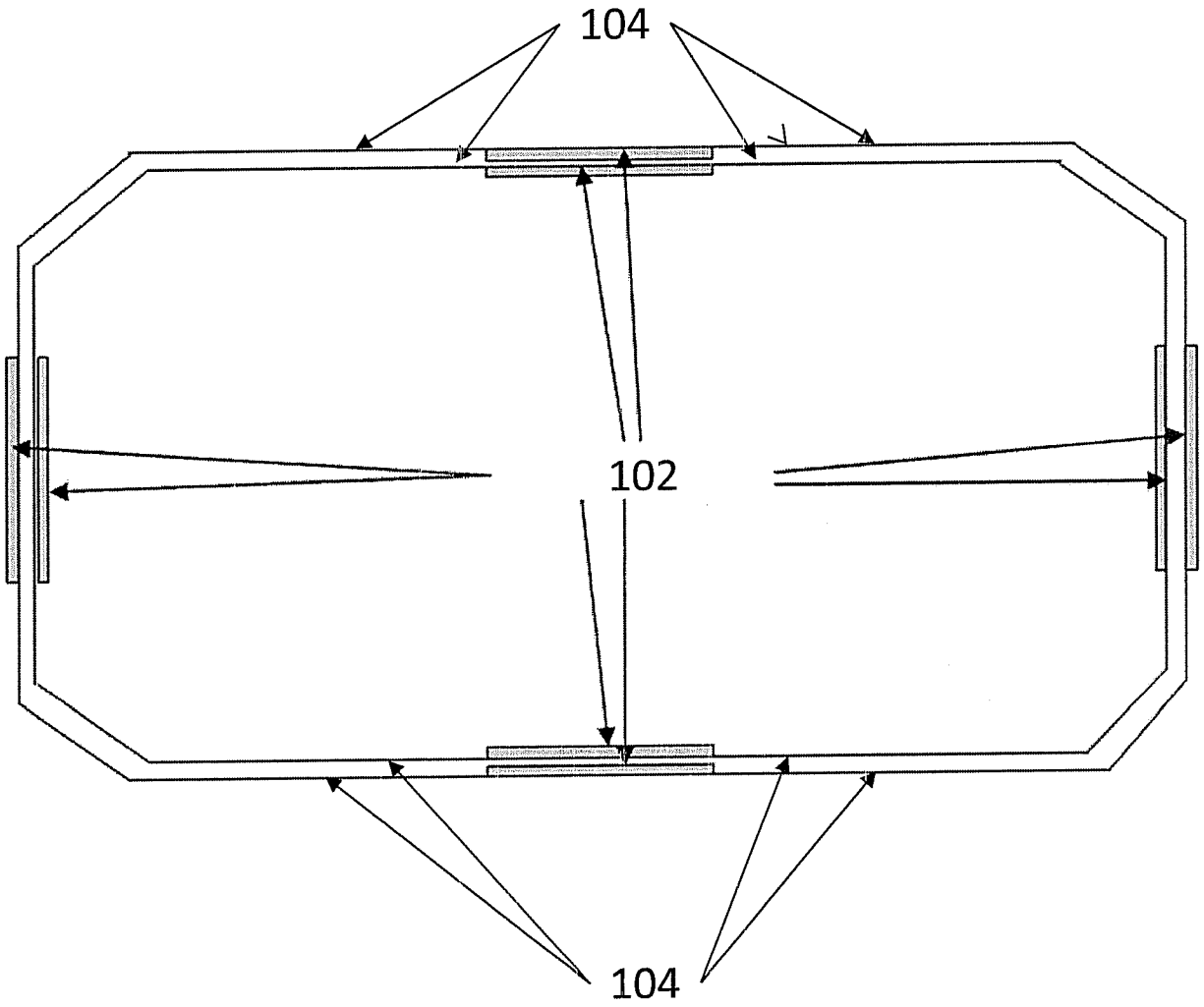
FIG. 2 is a top view of an exemplary embodiment of an adjustable bed frame.

FIG. 1 illustrates an exemplary embodiment of an adjustable bed frame 100. Adjustable bed frame 100 can include support rails 102, slide rails 104, and support risers 106. Support rails 102, slide rails 104, and support risers 106 can be arranged in any desired manner and form adjustable bed frame 100 into any desired shape, for example a square or rectangular box. In one exemplary embodiment, support rails 102 and slide rails 104 can be arranged into two frame segments, for example a top segment 108 and a bottom segment 110. Each frame segment 108 and 110 can contain four sides, which can be a head, a foot, and two lateral sides. Each side of frame segments 108 and 110 can have at its center a support rail 102, which can slidably engage a slide rail 104 at either end of support rail 102. The frame segments 108 and 110 can be adjustable in such a way that they can be arranged as a rectangle in which the head and foot sides are shorter in length than the lateral sides, or as a square in which all four sides are equal in length, or in any other desired manner. Frame segments 108 and 110 can be arranged so that, after each adjustment, all support rails 102 retain their position in the center of each side. Top segment 108 can be connected to bottom segment 110 and supported by support risers 106. In this manner, adjustable bed frame 100 can be shaped to accommodate standard rectangular or square mattress shapes, as desired. FIG. 2 shows an exemplary embodiment of adjustable bed frame 100 in which the frame segments 108 and 110 can be arranged as octagons.

Still referring to FIG. 1, support risers 106 can be arranged in any desired manner, for example with two on the head and foot sides and five on each of the lateral sides of adjustable bed frame 100. In another exemplary embodiment, eighteen support risers 106 can be used, with for example four being used on the head and foot sides and five on each lateral side. Support risers 106 can be constructed of any material, for example metals such as steel or aluminum, synthetic materials such as any type of plastic or nylon, ceramics, woods, or any other desired type of material. Support risers 106 can be shaped as desired, for example as tubes with cross-sections that are circular, rectangular, square, or any other regular or irregular shape as desired. In one exemplary embodiment, support risers 106 can be constructed of rectangular tubing with a square cross-section of about 1 inch per side. This can allow frame 100 to support any desired amount of weight, for example about 1200 pounds, and can also allow frame 100 to be flipped and used both top-to-bottom and bottom-to-top.

Figure 3:
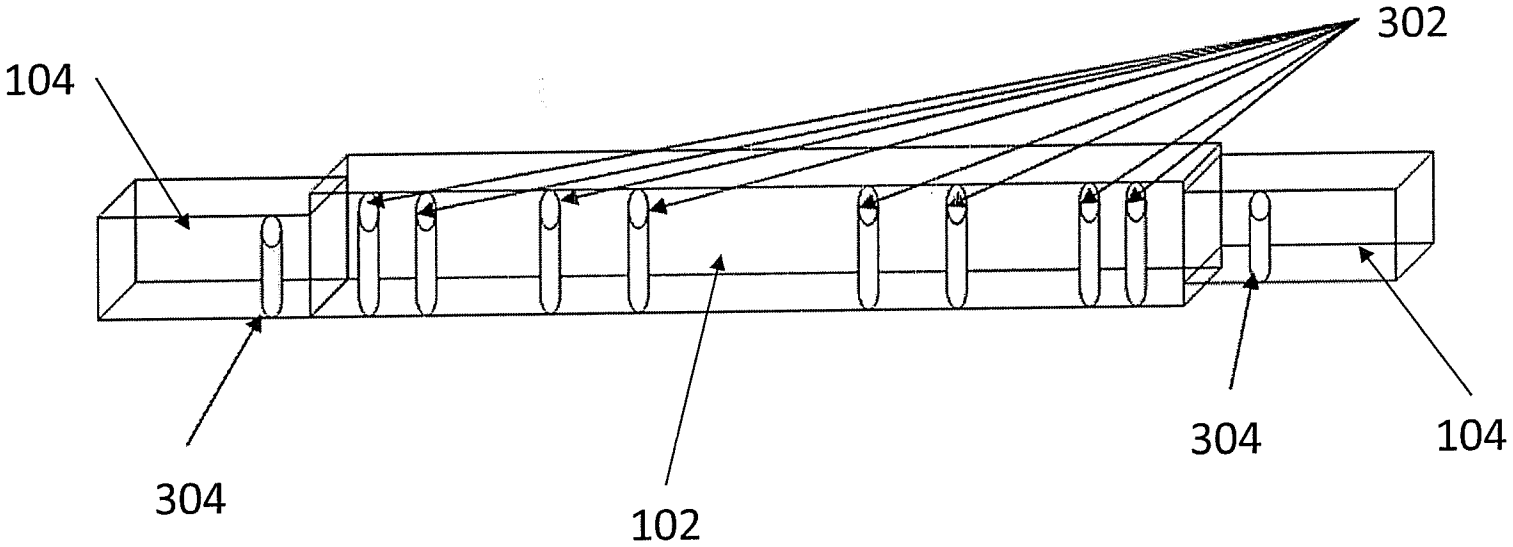
FIG. 3 is a side cutaway view of an exemplary portion of an exemplary embodiment of an adjustable bed frame.

FIG. 3 shows a side cutaway view of an exemplary embodiment of a support rail 102 interfacing with exemplary embodiments of portions of two slide rails 104. Support rails 102 and slide rails 104 can be constructed of any material, for example metals such as steel or aluminum, synthetic materials such as any type of plastic or nylon, ceramics, woods, or any other desired type of material. Support rails 102 and slide rails 104 can be shaped as desired, for example as tubes with cross-sections that are circular, rectangular, square, or any other regular or irregular shape as desired. Support rails 102 and slide rails 104 can be sized so that support rails 102 and slide rails 104 are of a different cross-sectional size. In this way support rails 102 and slide rails 104 can be slidably engaged with each other.

Still referring to FIG. 3, in one exemplary embodiment, support rails 102 and slide rails 104 can be constructed of rectangular tubing with square cross-sections. Support rails 102 can have square cross-sections that are about 1.25 inches per side, and slide rails 104 can have square cross-sections that are about 1 inch per side. In this way, slide rails 104 can be slidably engaged with support rails 102 by sliding slide rails 104 inside support rails 102.

Still referring to FIG. 3, support rails 102 can include fastening points for securing support rails 102 to slide rails 104. These fastening points can be any type of fastening or securing device as desired. In some exemplary embodiments, these fastening points can be adjustment holes. Support rails 102 can contain one or more support rail adjustment holes 302, and slide rails 104 can include one or more slide rail adjustment holes 304. Support rail adjustment holes 302 can be located at any desired position along support rails 102, and slide rail adjustment holes 304 can be located at any desired position along slide rails 104. Adjustment holes 302 and 304 can be of any desired shape and have any cross-section, for example square, rectangular, circular, ovoid, or any other desired cross-section. Adjustment holes 302 and 304 can allow slide rails 104 to be secured or fastened to support rails 102 at one or more different positions, and can in this way allow adjustable bed frame 100 to be assembled in such a way that it can accommodate any desired standard or non-standard mattress size.

Figure 4:
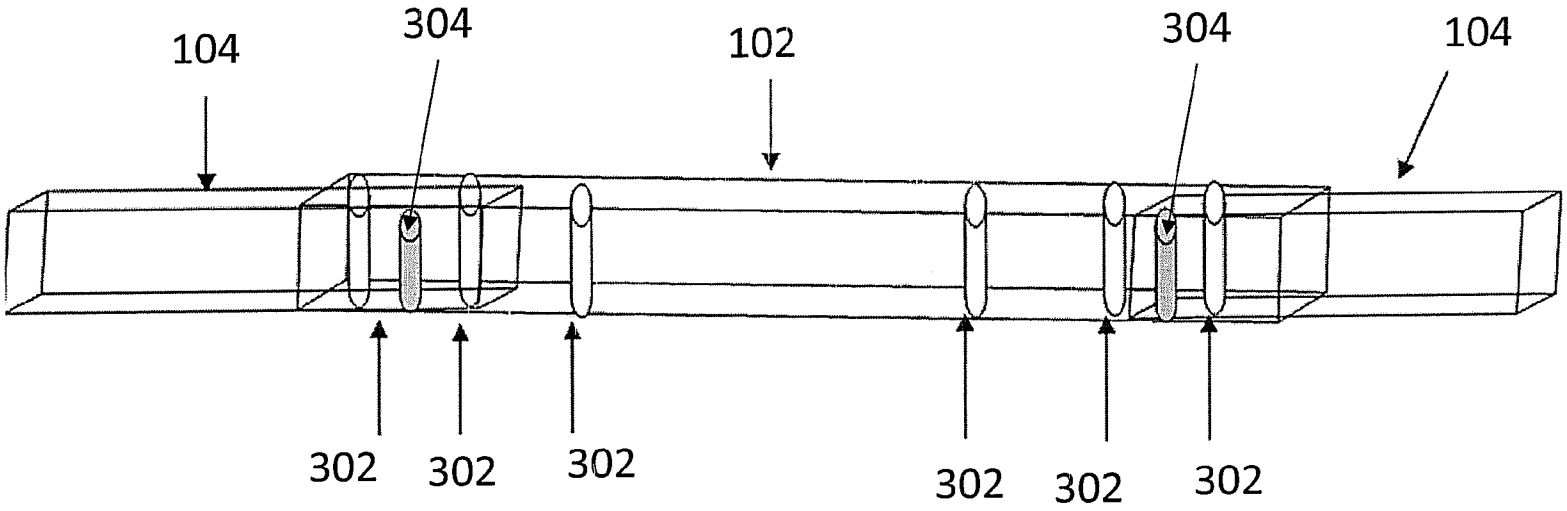
FIG. 4 is a side cutaway view of an exemplary portion of an exemplary embodiment of an adjustable bed frame.
Figure 5:
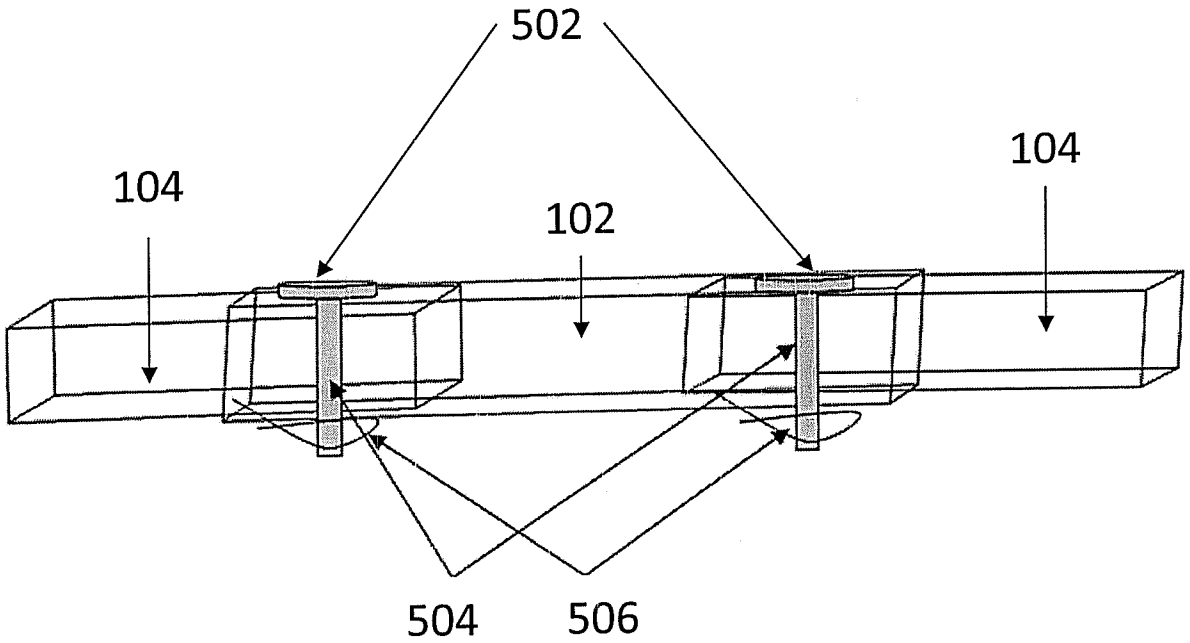
FIG. 5 is a side cutaway view of an exemplary portion of an exemplary embodiment of an adjustable bed frame.

FIG. 3 shows an exemplary embodiment of a portion of frame 100 prior to slidable engagement of a support rail 102 with slide rails 104. FIG. 4 shows an exemplary embodiment of a portion of frame 100 in which a support rail 102 is slidably engaged with slide rails 104 but is not yet fastened to slide rails 104. FIG. 5 shows an exemplary embodiment of a portion of frame 100 in which a support rail 102 is slidably engaged with and fastened to support rails 104.

Still referring to FIG. 5, adjustable bed frame 100 can include fasteners which can be adapted to secure support rails 102 to slide rails 104. Fastener 502 can be any type of fastener, including a screw, nut and bolt, tie, clamp, clasp, frog, rivet, anchor, strap, pin, or any other type of fastener as desired. In one exemplary embodiment, fastener 502 can include clevis pin 504, which can be inserted through adjustment holes 302 and 304, and hitch pin 506, which can be used to secure clevis pin 504 to frame 100.

In some embodiments, frame 100 can contain support rails 102 that are adapted to be used as the head and the foot of the frame 100 and that are different in size from support rails 102 that are adapted to be used as the lateral sides of the frame 100. In one exemplary embodiment, each slide rail 104 can have slide rail adjustment holes 304 that can be located about 2.25 inches from each end. In this embodiment, support rails 102 that are adapted to be used as the lateral sides of frame 100 can have support rail adjustment holes 302 that can be located about 5 inches, about 6 inches, about 11 inches, and about 16 inches from each end. Further, in this embodiment support rails 102 that are adapted to be used as the head and foot of frame 100 can have support rail adjustment holes that can be located about 3 inches, about 5 inches, and about 9 inches from each end. The various locations of adjustment holes 302 and 304 can allow frame 100 to be assembled in a variety of different configurations, allowing frame 100 to be configured to accommodate any desired mattress shape or size. In this way, any frame 100 can be variously assembled to accommodate mattresses in such sizes as twin, which can be about 39 inches by about 74 inches; twin extra long, which can be about 39 inches by about 80 inches; full, which can be about 54 inches by about 74 inches; full extra long, which can be about 54 inches by about 80 inches; queen, which can be about 60 inches by about 80 inches; king, which can be about 76 inches by about 80 inches; California king, which can be about 72 inches by about 84 inches; or any other desired standard or non-standard mattress size. In this and other embodiments, the support rails 102 can be configured so that after any adjustment is made, the support rails 102 remain in the center of each side of the frame.

Figure 6:
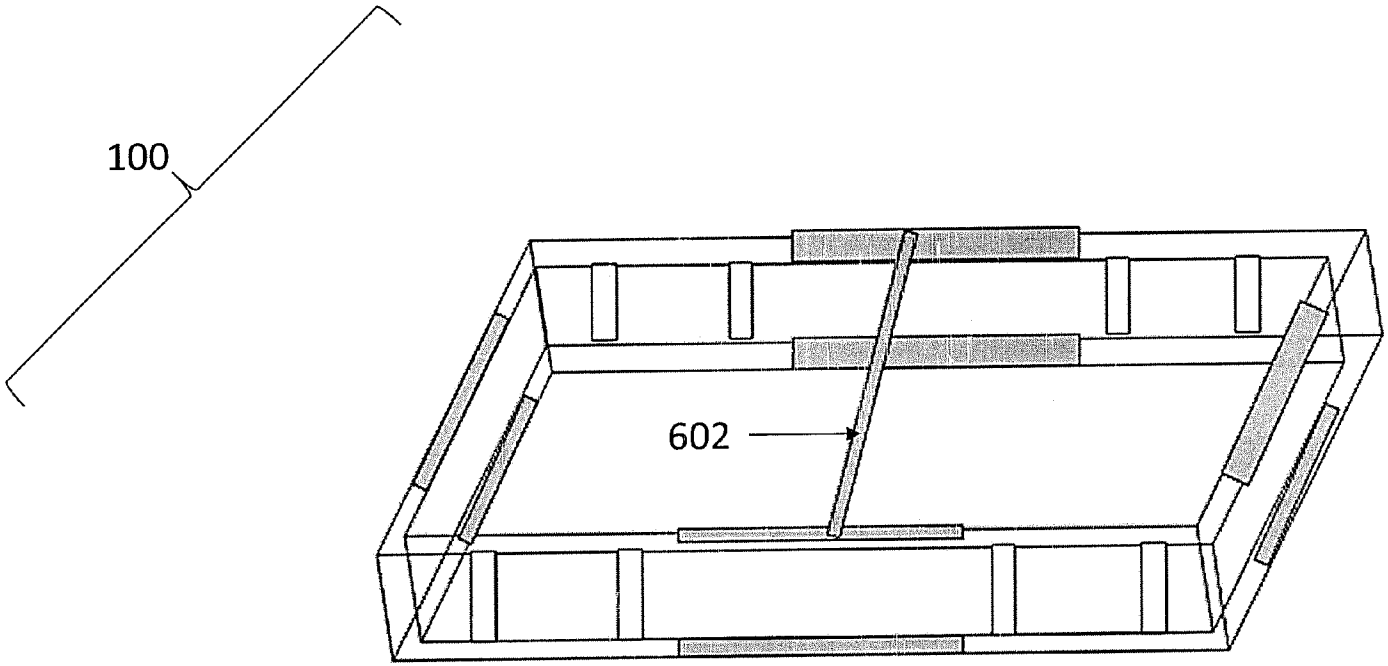
FIG. 6 is a side view of an exemplary embodiment of an adjustable bed frame.
Figure 7:
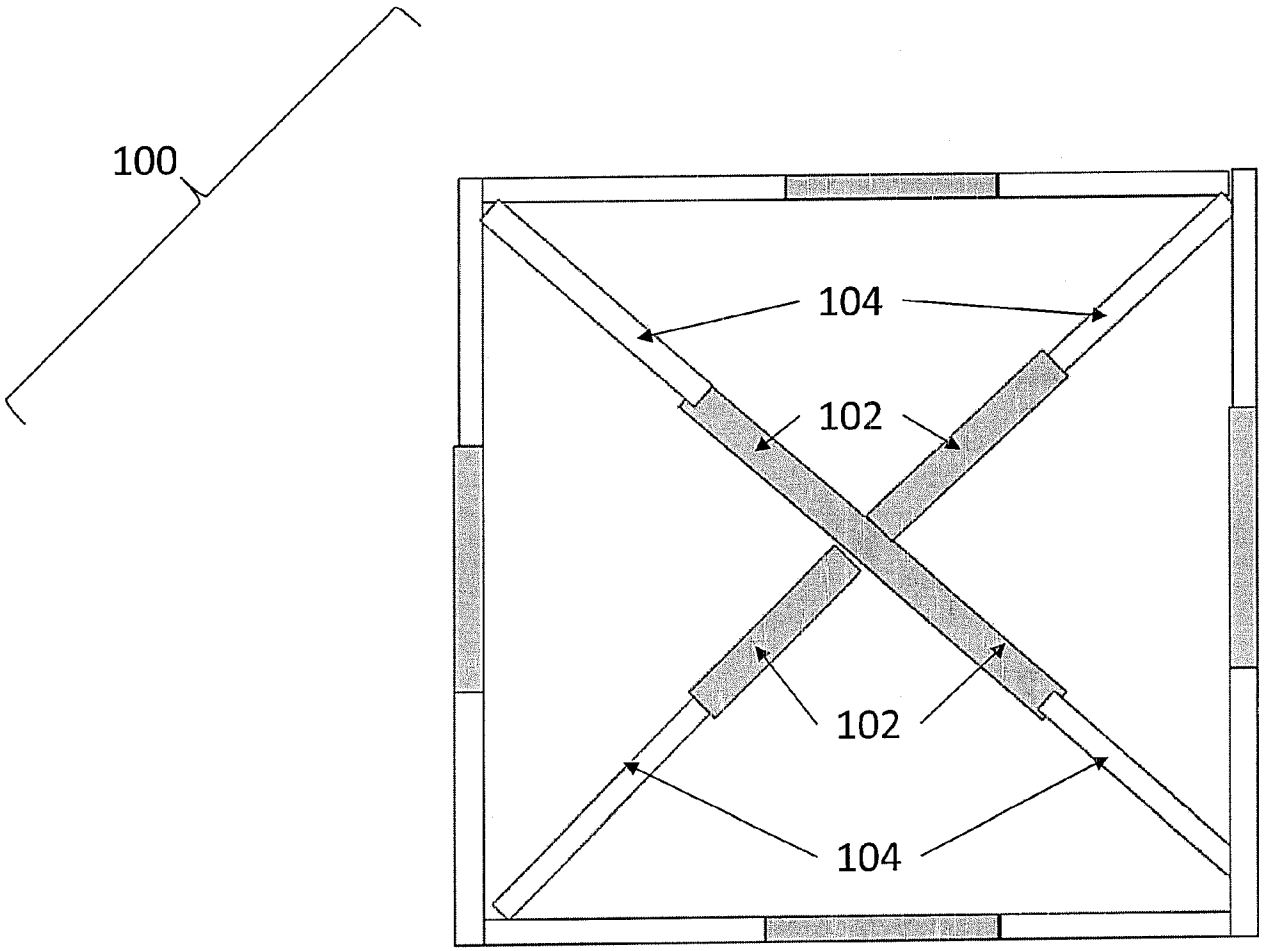
FIG. 7 is a top view of an exemplary embodiment of an adjustable bed frame.
Figure 8:
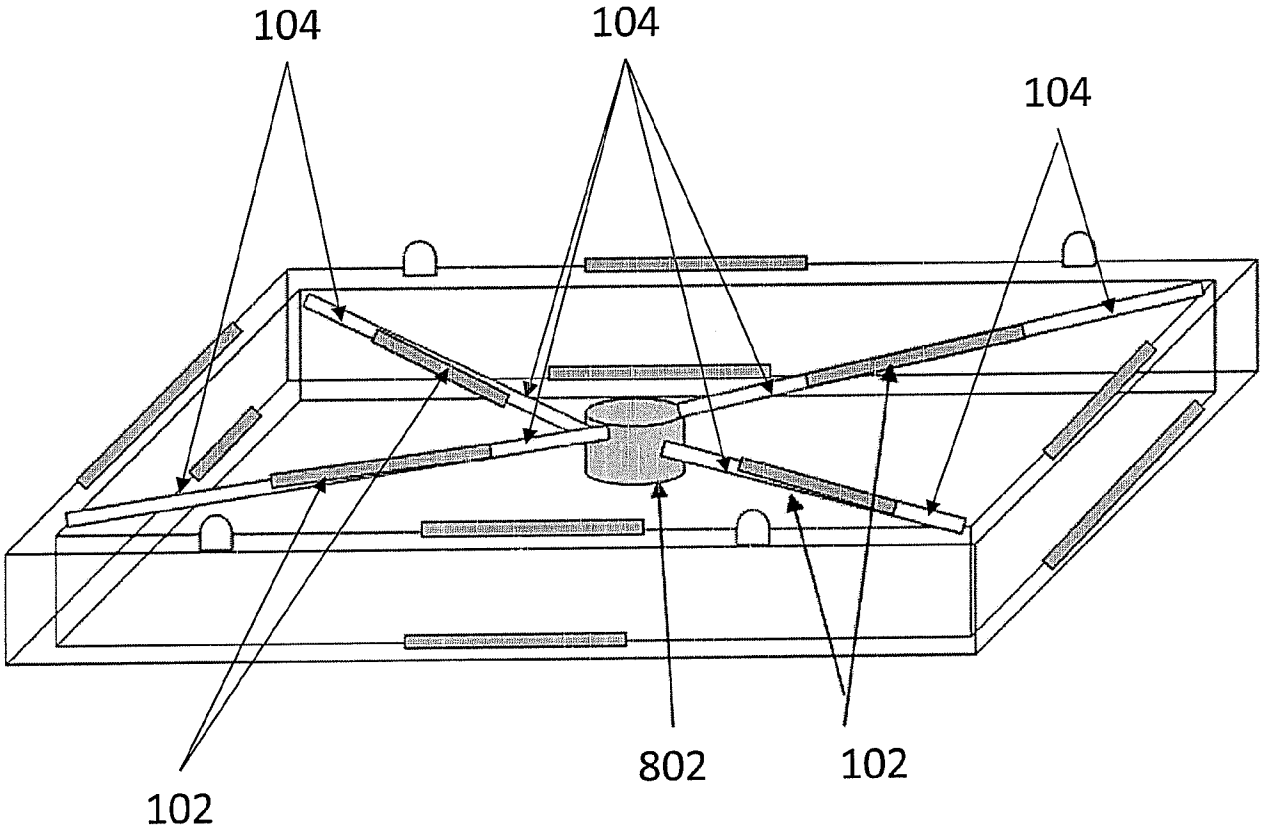
FIG. 8 is a side view of an exemplary embodiment of an adjustable bed frame.

Adjustable bed frame 100 can also include any desired configuration of central support structures located in the central portion of the frame 100. FIG. 6 shows an exemplary embodiment of a frame 100 which includes a lateral support brace 602 fastened at each end to a support rail 102 located on the lateral sides of a top frame segment 108. FIG. 7 shows an exemplary embodiment of a frame 100 which includes support rails 102 and slide rails 104 fastened at or near the corners of frame 100 in order to provide support. FIG. 8 shows an exemplary embodiment of a frame 100 which includes a central support hub 802, which is connected to frame 100 by diagonally oriented support rails 102 and slide rails 104. These and other embodiments can also include mattress clips adapted to secure a mattress to a frame 100.

The foregoing description and accompanying drawings illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An adjustable bed frame, comprising:

one or more support rails, with one or more fastening points;

one or more slide rails; and one or more support risers;

wherein each of the one or more slide rails is slidably engaged with at least one of the one or more support rails and adjustably fastens at the one or more fastening points;

the one or more slide rails and the one or more support rails are adjustably assembled into top and bottom frame segments wherein the top and bottom frame segments each include a head side, a foot side, and two lateral sides wherein each side of the top and bottom frame segments includes one of the one or more support rails at a center of the side, and each support rail of the one or more support rails is adjustably fastened to an associated one of the one or more slide rails at an end thereof, wherein each one of the one or more slide rails slidably adjusts into an associated one of the one or more support rails in such a way that at least one of the one or more support rails is at the center of each side of the top and bottom frame segments;

the top frame segment is connected to the bottom frame segment and supported by the one or more support risers;

the top and bottom frame segments are adjustable to accommodate more than one mattress size; and a central support structure wherein the central support structure comprises a central support hub connected to the frame with one or more diagonally positioned hub support rails relative to the top and bottom frame segments and connected to the frame with one or more diagonally positioned hub slide rails relative to the top and bottom frame segments.

2. The adjustable bed frame of claim 1, wherein the adjustable bed frame is adjustable in size to accommodate at least one of:

a twin mattress;

a twin extra long mattress;

a full mattress;

a full extra long mattress;

a queen mattress;

king mattress; and a California king mattress.

3. The adjustable bed frame of claim 1, further comprising one or more clevis pins and one or more hitch pins.

4. The adjustable bed frame of claim 1, wherein the adjustable bed frame can be used upside-down.

5. The adjustable bed frame of claim 1, wherein the adjustable bed frame is capable of supporting at least 1200 pounds.

* * * * *